US008860612B2

(12) United States Patent
Kim

(10) Patent No.: US 8,860,612 B2
(45) Date of Patent: Oct. 14, 2014

(54) ANTENNA DEVICE FOR GENERATING RECONFIGURABLE HIGH-ORDER MODE CONICAL BEAM

(75) Inventor: Joung Myoun Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 223 days.

(21) Appl. No.: 13/612,578

(22) Filed: Sep. 12, 2012

(65) Prior Publication Data

US 2013/0076585 A1 Mar. 28, 2013

(30) Foreign Application Priority Data

Sep. 23, 2011 (KR) ..... 10-2011-0096139

(51) Int. Cl.
*H01Q 1/38* (2006.01)
*H01Q 9/04* (2006.01)

(52) U.S. Cl.
CPC ..... *H01Q 9/0414* (2013.01); *H01Q 9/0435* (2013.01); *H01Q 9/045* (2013.01)
USPC ..... 343/700 MS; 343/787; 343/876

(58) Field of Classification Search
CPC .... H01Q 1/243; H01Q 9/0414; H01Q 9/0435
USPC ..... 343/700 MS, 876, 787
See application file for complete search history.

(56) References Cited

U.S. PATENT DOCUMENTS 6,496,147 B1 * 12/2002 Kirino ..... 343/700 MS
2009/0028074 A1 * 1/2009 Knox ..... 370/278
2010/0156607 A1 * 6/2010 Lankes et al. ..... 340/10.5

FOREIGN PATENT DOCUMENTS

KR 10-2005-0120442 A 12/2005
KR 10-2008-0062843 A 7/2008

* cited by examiner

*Primary Examiner* — Tan Ho
(74) *Attorney, Agent, or Firm* — William Park & Associates Patent Ltd.

(57) ABSTRACT

An antenna device for generating a reconfigurable high-order mode conical beam, includes a micro-strip radiator having multiple feeding points, wherein one of the feeding points is a fixed feeding point, and a feeding unit for providing two signals having a same amplitude and a preset phase difference, wherein one of the two signals is fed through the fixed feeding point and the other is fed through any one of remaining feeding points. A mode reconfigurable switching unit, connected to the feeding unit, performs a switching operation to select any one of the remaining feeding points so that the other signal is feed through the selected feeding point in accordance with mode control data.

11 Claims, 9 Drawing Sheets

ANTENNA DEVICE FOR GENERATING RECONFIGURABLE HIGH-ORDER MODE CONICAL BEAM

CROSS-REFERENCE(S) TO RELATED APPLICATION(S)

The present invention claims priority of Korean Patent Application No. 10-2011-0096139, filed on Sep. 23, 2011, which is incorporated herein by reference.

FIELD OF THE INVENTION

The present invention relates to an antenna device capable of controlling beams from the antenna device, and more particularly, to an antenna device for generating a reconfigurable high-order mode conical beam, with improved transmission and reception characteristics of transmission and reception antennas through the control of antenna beam pattern characteristics thereof in a wireless communication system.

BACKGROUND OF THE INVENTION

In a mobile satellite communication system, circularly polarized antennas having high gain characteristics in an elevation angle direction and non-directional characteristics in an azimuth direction are required to be terminal antennas mounted in a terrestrial moving terminal. A cross-dipole quadrifilar helix antenna has been commonly used for the purpose of being utilized as a non-directional circularly polarized antenna in the azimuth direction.

However, since the structure of such a cross-dipole quadrifilar helix antenna has high profile characteristics, it is not appropriate for an antenna structure to be mounted in the terrestrial mobile terminal. In addition, when the mobile terminal is on the move, an elevation angle direction between the antenna and a satellite object (or a target) is changed depending on the pitch of a road or a change in a latitude to result in a lower radiation pattern performance of the antenna in the mobile terminal to degrade link characteristics in a mobile wireless communication system or mobile broadcast system.

SUMMARY OF THE INVENTION

In view of the above, the present invention provides an antenna device for generating a reconfigurable high-order mode conical beam through the control of antenna beam pattern characteristics thereof.

Further, the present invention provides an antenna device for providing high gain characteristics in an elevation angle direction and non-directional characteristics and circular polarization characteristics in an azimuth direction.

In accordance with an aspect of the present invention, there is provided an antenna device for generating a reconfigurable high-order mode conical beam, including: a micro-strip radiator having multiple feeding points, wherein one of the feeding points is a fixed feeding point; a feeding unit for providing two signals having a same amplitude and a preset phase difference, wherein one of the two signals is fed through the fixed feeding point and the other is fed through any one of remaining feeding points; and a mode reconfigurable switching unit, connected to the feeding unit, for performing a switching operation to select any one of the remaining feeding points so that the other signal is feed through the selected feeding point in accordance with mode control data.

In embodiment, the micro-strip radiator has a single micro-strip circular disk or a micro-strip circular radiator with a circular ring shape. For micro-strip circular radiator with a circular ring shape, the feeding points are positioned at an outer side of the micro-strip circular radiator.

In the embodiment, the micro-strip radiator is formed on a first dielectric substrate whose relative permittivity value is changed depending on a voltage applied thereto.

In the embodiment, the first dielectric substrate is made of a ferro-electric material whose permittivity is changed depending on the applied voltage.

In the embodiment, the feeding unit comprises any one of a T-matching signal distributor, a 90° branch line coupler, and a Wilkinson power distributor.

In the embodiment, the signal fed through the selected feeding point is provided via a transmission line having a length of $\theta a+\theta b$, and the signal provided from the feeding unit to the mode reconfigurable switching unit is provided to the selected feeding point a transmission lines having a length of $\theta a+\theta b$ between each output terminal of the mode reconfigurable switching unit and each of the remaining feeding points, wherein the length $\theta b$ is 0° or 180°.

In the embodiment, the signal fed through the fixed feeding point is provided via a transmission line having a length of $\theta a+\theta b$.

In the embodiment, the mode reconfigurable switching unit comprises an SP4T (Single-Pole Four-Throw) switch.

BRIEF DESCRIPTION OF THE DRAWINGS

The above and other objects and features of the present invention will become apparent from the following description of embodiments, given in conjunction with the accompanying drawings, in which.

DETAILED DESCRIPTION OF THE EMBODIMENTS

Figure 1:
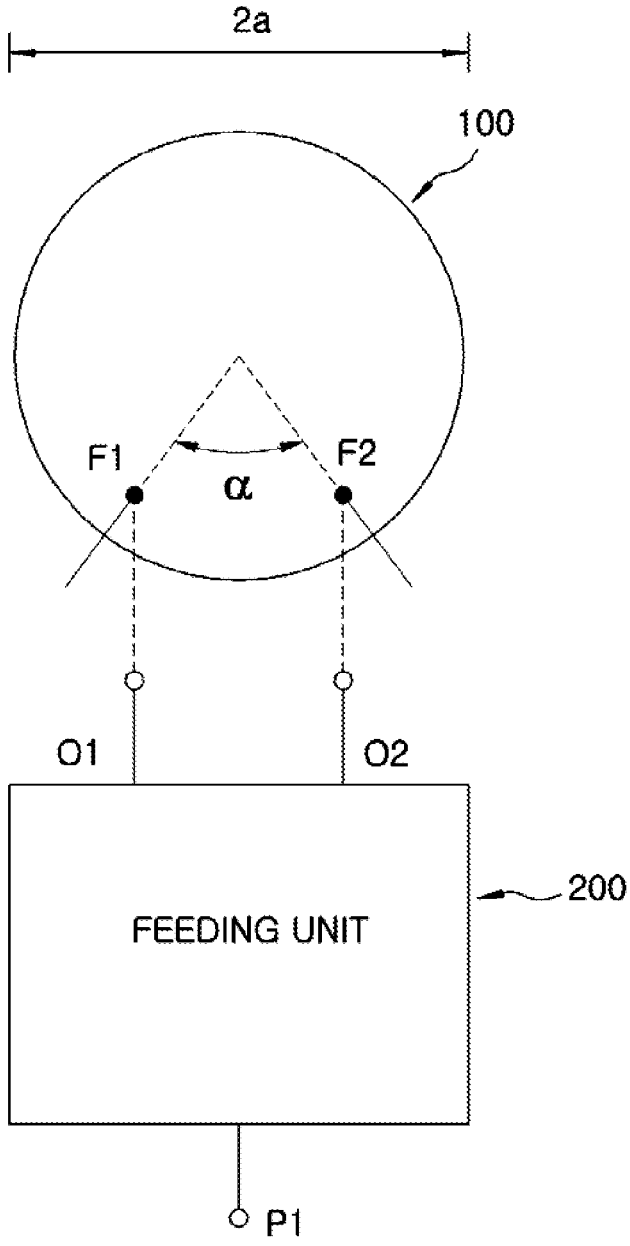
FIG. 1 illustrates a configuration of a high-order mode excitation single antenna used for generating a conical beam having circular polarization characteristics in accordance with the related art.

Hereinafter, a reconfigurable conical beam antenna device having circular polarization characteristics in accordance with embodiments of the present invention will be described in detail with the accompanying drawings, wherein the same or similar reference numerals are used for the same elements throughout the drawings.

Before explaining the present invention, first, an antenna device for generating a conical beam having circular polarization characteristics will be described in more detail with reference to FIGS. 1 to 3.

FIG. 1 illustrates a configuration of a high-order mode excitation single antenna used for generating a conical beam having circular polarization characteristics in accordance with the related art. The antenna as shown in FIG. 1 includes a micro-strip circular radiator 100 for generating a high-order mode and a feeding unit 200 for providing signals having the same amplitude and a ±90° phase difference.

A resonance frequency for a TM mode of the micro-strip circular radiator 100 is expressed by Equation 1 shown below:

$$f_{nm} = \frac{x_{nm} \cdot c}{2 \cdot \pi \cdot a_{eff} \cdot \sqrt{\varepsilon_r}} \quad \text{Eq. (1)}$$

In Eq. (1), $x_{nm}$ is an m-th zero root of a differential equation of an n-order Bessel function wherein count values of $x_{nm}$ in each mode are summarized and shown in Table 1. 'c' is a light velocity in a free space, $\epsilon_r$ is a relative permittivity, and $a_{eff}$ is an effective radius of a circular radiator and may be expressed by Equation 2.

TABLE 1

| Mode | $TM_{11}$ | $TM_{21}$ | $TM_{31}$ | $TM_{41}$ | $TM_{51}$ | $TM_{61}$ |
|---|---|---|---|---|---|---|
| $x_{nm}$ | 1.0 | 3.054 | 4.201 | 5.317 | 6.415 | 7.501 |

$$a_{eff} = a \cdot \left[1 + \frac{2h}{\pi \cdot a \cdot \varepsilon_r}\left(\ln\frac{\pi \cdot a}{2 \cdot h} + 1.7726\right)\right]^{\frac{1}{2}}, \ \frac{a}{h} >> 1 \quad \text{Eq. (2)}$$

In order to exhibit circular polarization characteristics in the micro-strip circular radiator 100, two feeding points F1 and F2 having a ±90° phase difference need to be provided, and an excitation mode is determined by an angle α between the two feeding points F1 and F2.

Figure 2A:
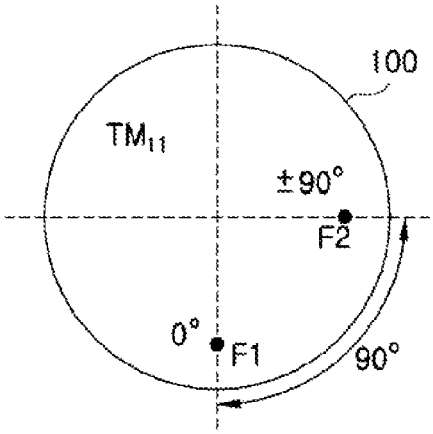
FIGS. 2A to 2D are views illustrating a method for exciting each mode having circular polarization characteristics in the micro-strip circular radiator shown in FIG. 1.
Figure 2B:
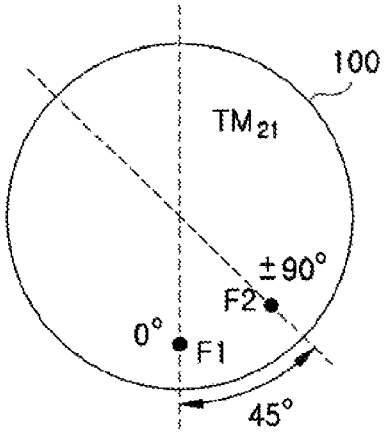
Figure 2C:
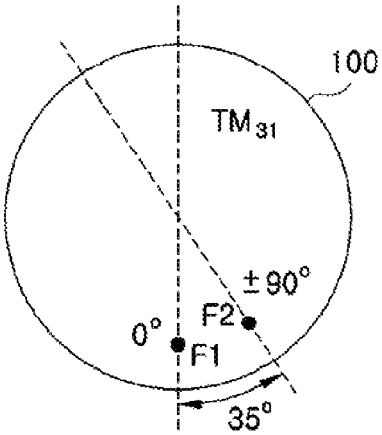
Figure 2D:
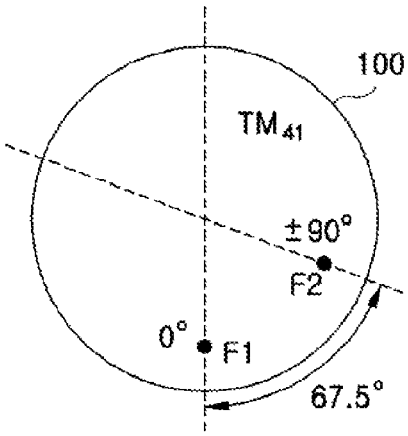
Figure 3:
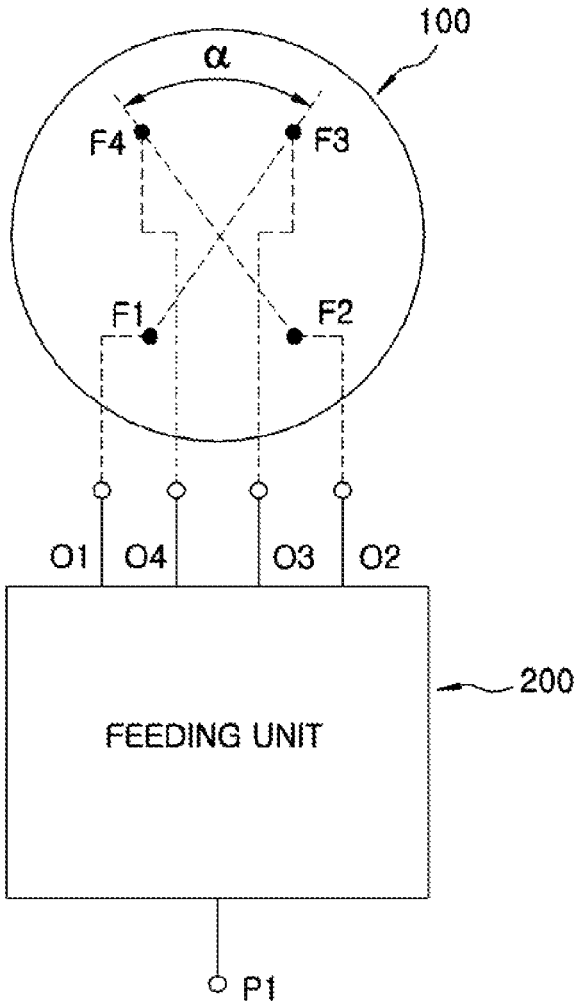
FIG. 3 is a view illustrating a method for exciting four feed points to have beam symmetry and low cross polarization characteristics.
Figure 4A:
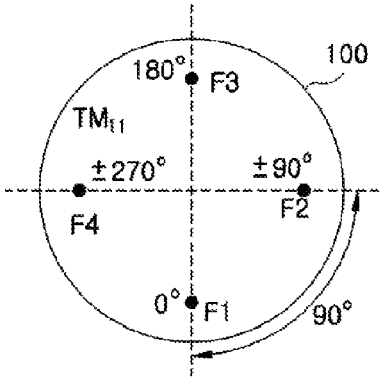
FIGS. 4A to 4D are views illustrating a method for exciting each mode using four feed points.
Figure 4B:
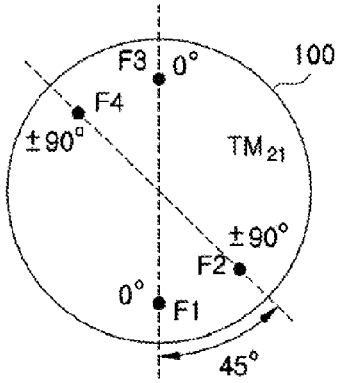
Figure 4C:
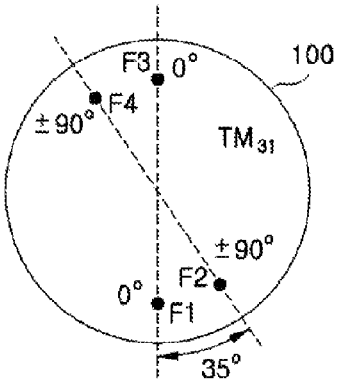
Figure 4D:
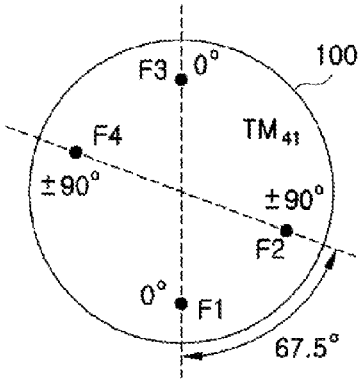

FIGS. 2A to 2D are views illustrating a method for exciting each mode having circular polarization characteristics in the micro-strip circular radiator shown in FIG. 1. As shown in FIG. 2A, a phase difference between the two feeding points F1 and F2 of the micro-strip circular radiator 100 should be ±90°. That is, when α=90°, the $TM_{11}$ basic mode is excited. When α=45° or 135° in FIG. 2B, the $TM_{21}$ second-order mode is excited. When α=30° or 90° in FIG. 2C, the $TM_{31}$ third-order mode is excited, and when α=22.5° or 67.5° in FIG. 2D, the $TM_{41}$ fourth-order mode is excited. Electric fields radiated from the two feeding points F1 and F2 are perpendicular to each other. Further, one feeding point is positioned in a null field region of the other feeding point all the time, making mutual coupling characteristics between the two feeding points F1 and F2 very weak.

In particular, for a circular radiator implemented on a thick dielectric material, undesired modes need to be suppressed in order to maintain beam symmetry and have low cross-polarization characteristics.

In general, two adjacent modes adjacent to a resonant mode have the next-largest amplitude size over that of the resonant mode. One of methods for suppressing the adjacent modes is to provide a configuration having a total of four feeding points, i.e., a configuration having two feeding points F1 and F2 and two additional feeding points F3 and F4 placed at positions diagonally facing the two feeding points F1 and F2, as shown in FIG. 3.

FIGS. 4A to 4D are views illustrating a method for exciting each mode using four feed points F1, F2, F3, and F4. In FIG. 4, even number order modes ($TM_{21}$, $TM_{41}$) should have a phased array of 0°, 90°, 0°, 90° and odd number order modes ($TM_{11}$, $TM_{31}$) should have a phased array of 0°, 90°, 180°, 270° such that undesired electric fields radiated from the opposite feeding points of the respective pairs are offset with each other.

The overall electric fields radiated from the circular radiator 100 having the four feeding points F1, F2, F3, and F4 may be expressed by Equations 3 and 4 shown below:

$$E_\theta^T = E_\theta^1(\phi,\theta) + jE_\theta^2(\phi+\alpha,\theta) + \mathrm{sgn}(n)\lfloor E_\theta^3(\phi+180°, \theta) + jE_\theta^4(\phi+180°+\alpha,\theta)\rfloor \quad \text{Eq. (3)}$$

$$E_\phi^T = E_\phi^1(\phi,\theta) + jE_\phi^2(\phi+\alpha,\theta) + \mathrm{sgn}(n)\lfloor E_\phi^3(\phi+180°,\theta) + jE_\phi^4(\phi+180°+\alpha,\theta)\rfloor \quad \text{Eqn. (4)}$$

In Equations 3 and 4, suffixes 1, 2, 3, and 4 indicate an influence of the radiated electric fields by the four feeding points, and α indicates an angle between two feeding points. Also, sgn(n) has a value +1 when n becomes an even number and sgn(n) has a value −1 when n becomes an odd number.

Figure 5:
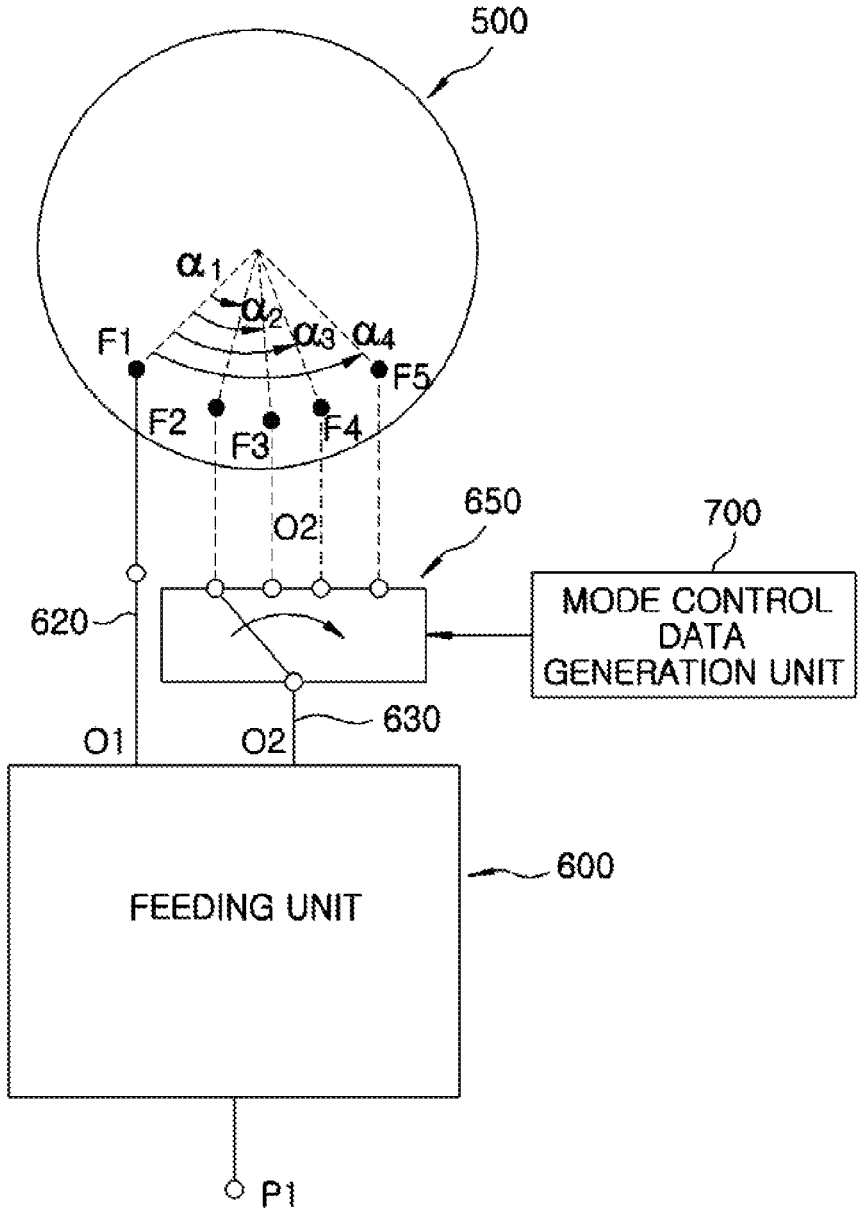
FIG. 5 illustrates a configuration of an antenna device for generating a reconfigurable high-order mode conical beam having circular polarization characteristics in accordance with an embodiment of the present invention.

FIG. 5 illustrates an antenna device for generating reconfigurable high-order mode conical beam having circular polarization characteristics in accordance with the embodiment of the present invention, which is derived from the foregoing principle as described with reference to FIGS. 1 to 4. The antenna device includes a micro-strip circular radiator 500 having feeding points F1, F2, F3, F4 and F5, a feeding unit 600 providing signals having the same amplitude and ±90° phase difference, a mode reconfigurable switching unit 650 controlled by mode control data, and a mode control data generation unit 700.

Figure 6:
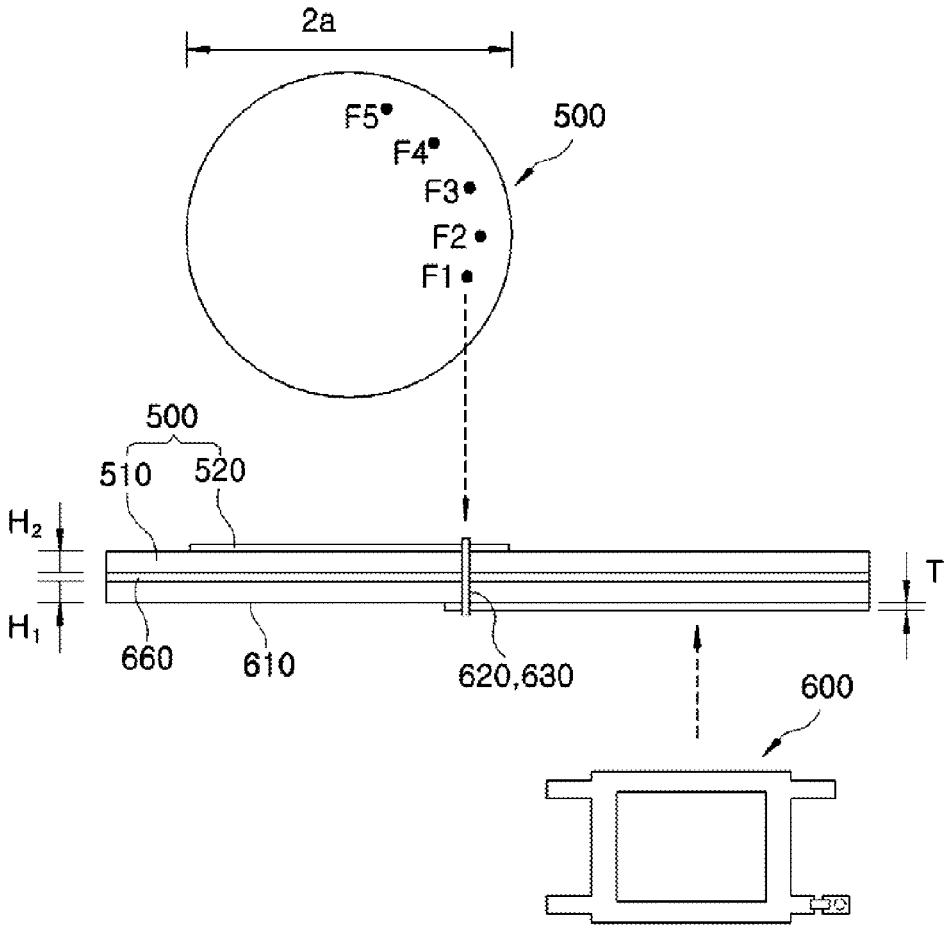
FIG. 6 is a view showing a configuration of a micro-strip circular radiator in accordance with an embodiment of the present invention.

FIG. 6 illustrates the antenna device including a micro-strip stack radiator in which multiple single micro-strip circular radiators are stacked.

As shown in FIG. 6, the single micro-strip circular radiator 500 is configured as a single micro-strip circular disk 520 having a diameter 2*a* and disposed on a first dielectric substrate 510 which constitute the single micro-strip circular radiator 500. The micro-strip stack radiator includes a single micro-strip circular disk 660 disposed on a second dielectric substrate 610 along with the single micro-strip circular radiator 500. The feeding unit 600 configured as a 90° branch line coupler is disposed on the second dielectric substrate 610. One of the feeding points, i.e., a feeding point F1 is fixedly connected to a first coaxial transmission line 620 and any one of remaining feeing points F2, F3, F4, and F5 is selectively connected to a second coaxial transmission line 630.

As described above, a resonance frequency for a TM mode of the radiator 500 in Equation 1 needs to be uniformly maintained, and to this end, the size of the micro-strip circular radiator 500 needs to be physically changed for each selected mode. In accordance with an embodiment of the present invention, it is accomplished by forming the first dielectric substrate 510 to have a ferro-electric material and changing relative permittivity of the ferro-electric material through the control of voltage applied thereto. In other words, the first dielectric substrate 510 on which the micro-strip circular radiator 500 is formed of a ferro-electric material of which relative permittivity is changed depending on an applied voltage. For example, if it is assumed that reference relative permittivity value is $e_{r1}=e_{rr}$ in the $TM_{11}$ mode, relative permittivity value of the ferro-electric material of the first dielectric substrate 510 may be adjusted by controlling a voltage such that $e_{r1}=9.3e_{rr}$ in $TM_{21}$ mode, $e_{r1}=17.6e_{rr}$ in $TM_{31}$ mode, and $e_{r1}=28.3e_{rr}$ in $TM_{41}$ mode.

Referring back to FIG. 5, the feeding unit 600 is formed on the second dielectric substrate 610 and provides two signals having same amplitude and ±90° phase difference to the micro-strip circular radiator 500. The feeding unit 600 is connected to the micro-strip circular radiator 500 through the first and second coaxial transmission lines 620 and 630. More specifically, the feeding unit 600 is connected to the feeding point F1 of the micro-strip circular radiator 500 through the first coaxial transmission line 620, and is connected to another feeding point, e.g., any one of F2, F3, F4, and F5, depending on a switching operation of the mode reconfigurable switching unit 650 through the second coaxial transmission line 630.

The micro-strip circular radiator 500 having the single micro-strip circular radiator as described above provides narrowband characteristics, and is fed through a feeding point of an appropriate position, which is connected to a 50 Ω input terminal, within the micro-strip circular radiator 500 via the first coaxial transmission line 620. Further, in order to implement a plane type direct feeding scheme, the feeding unit 600 should serve as an impedance converter, and therefore, as shown in FIGS. 7A to 7C, the feeding unit 600 may be implemented as one of three types of feeding configurations, e.g., a T-matching signal distributor, a 90° branch line coupler, and a Wilkinson power distributor.

Figure 7A:
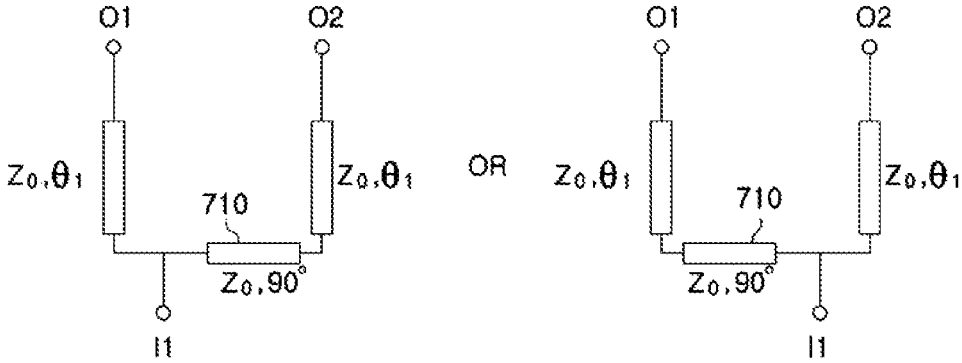
FIGS. 7A to 7C are views showing a feeding units for providing signals having the same amplitude and a ±90° phase difference in accordance with an embodiment of the present invention.
Figure 7B:
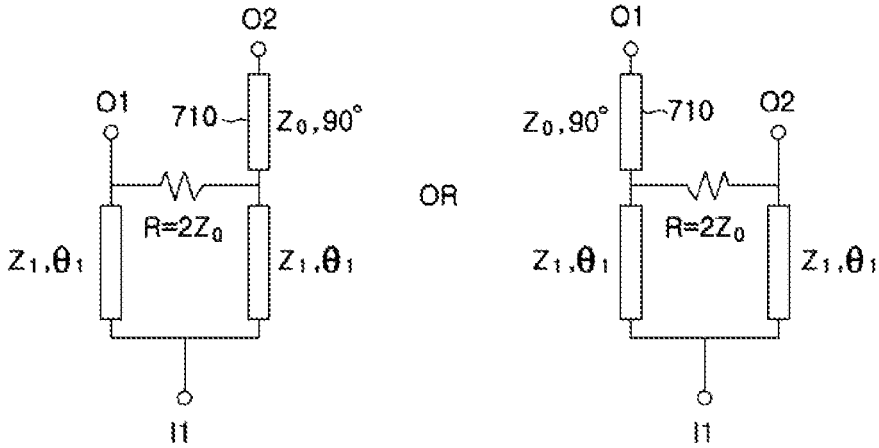
Figure 7C:
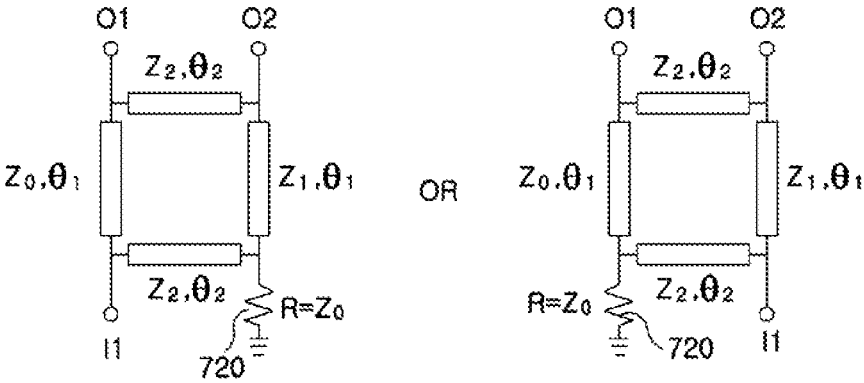

The feeding unit 600 as shown in FIGS. 7A and 7B includes an additional 90° phase delay line 710 coupled to the transmission line at right or left. The feeding unit 600 as shown in FIG. 7C includes an input line 720 coupled to the transmission line at right or left to provide a signal having a 90° phase difference.

The mode reconfigurable switching unit 650 performs a switching operation to select any one of four output terminals connected to the corresponding feeding points F2, F3, F3, F4 and F5 so that a signal is outputted through the selected output terminal. For example, the mode reconfigurable switching unit 650 may have an SP4T (Single-Pole Four-Throw) switch. The mode reconfigurable switching unit 650 allows the transmission line 630 of the feeding unit 600 to connect with any one of the feeding points F2, F3, F4, and F5 based on mode control data provided from the mode control data generation unit 700.

The mode control data generation unit 700 generates the mode control data to select a corresponding feeding point in accordance with each mode of the antenna device, and provides the generated mode control data to the mode reconfigurable switching unit 650. Also, the mode control data generation unit 700 controls a voltage supplied to the first dielectric substrate 510 on which the micro-strip circular radiator 500 is formed. That is, the mode control data generation unit 700 stores voltage values for respective modes and controls a voltage applied to the first dielectric substrate 510 using a voltage value corresponding to each mode in generating the mode control data.

Figure 8:
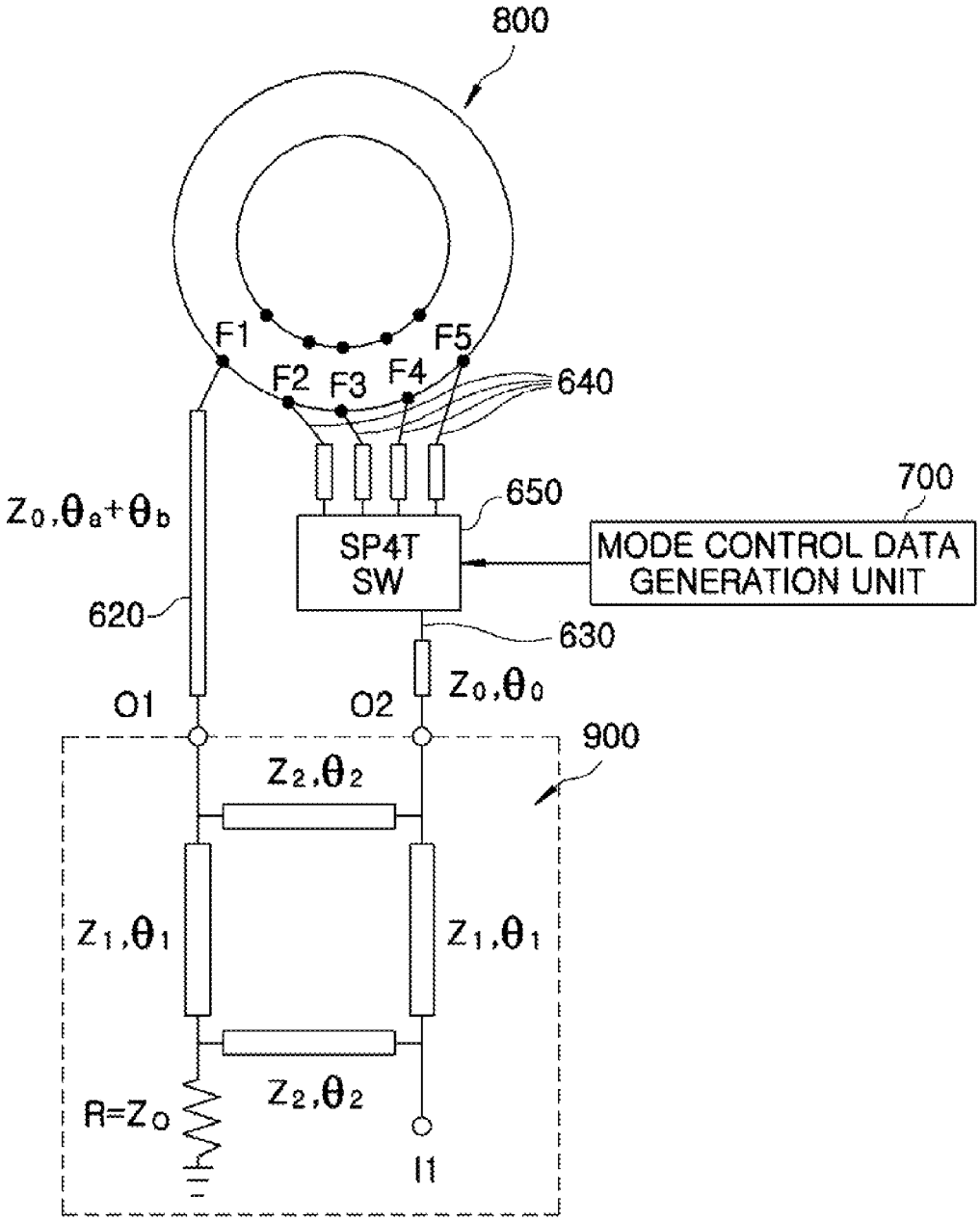
FIG. 8 illustrates an antenna device including in accordance with another embodiment of the present invention.

In an embodiment of the present invention, it has been described that the micro-strip circular radiator 500 has a single micro-strip circular radiator by way of an example. However, the micro-strip circular radiator 500 may be implemented with a micro-strip circular radiator 800 having a circular ring shape as shown in FIG. 8. That is, as shown in FIG. 8, the micro-strip circular radiator 800 having a circular ring shape may implement 50-Ω input impedance by appropriately adjusting a distance between the micro-strip circular radiator 800 and a parasitic radiator, and therefore feeding points F1, F2, F3, F4, and F5 are positioned at an outer side of the annular ring.

A length of a first transmission line 620 connected to a feeding point F1 should satisfy θa+θb, and a phase error potentially generated by the SP4T switch 650 should also be corrected. Similarly, a length of a second transmission line 630 connected between the mode reconfigurable switching unit and the feeding unit 900 and a length of a third transmission line 640 connected to each feeding point also be θa+θb are also θa+θb; however, θb is set as 0° or 180°. This is to open θb of a transmission line of unselected feeding points. In consideration of symmetry of the conical radiation beam pattern, it is preferable that $\theta_b$ of the transmission line is 0°.

Figure 9:
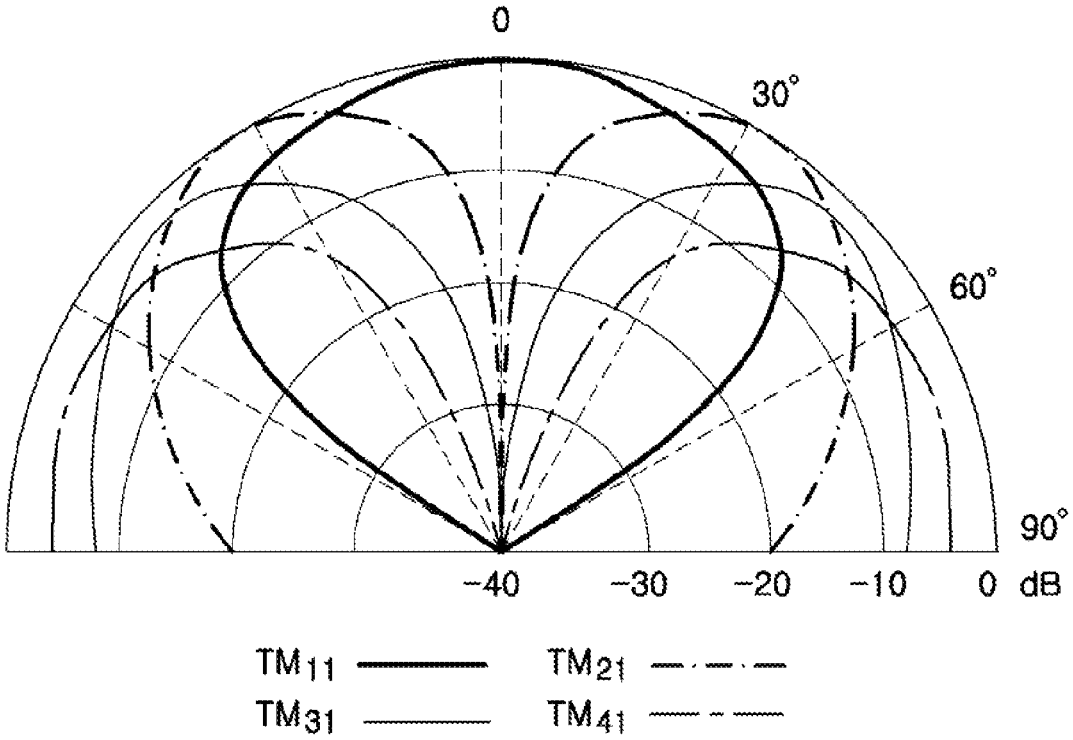
FIG. 9 is a view showing a high-order mode radiation pattern obtained by performing a reconfiguration of high-order radiation mode in accordance with an embodiment of the present invention.

In the antenna device for generating a reconfigurable conical beam having the circular polarization characteristics as described above, it can be seen from FIG. 9, respective radiation patterns have improved cross characteristics by the symmetry of the feeding configuration in a high-order mode through reconfiguration. That is, it can be seen that, as the mode is increased toward high-order mode, the radiation pattern is inclined from a forward direction to a horizontal direction.

In accordance with the present invention, technically, an advantage in that an elevation angle change of an antenna beam depending on the pitch of a road or a change in a latitude while on the move can be implemented through a simple electrical controlling method is provided, and in addition, economically, a low-priced mobile satellite terminal antenna having a low profile can be provided.

While the invention has been shown and described with respect to the embodiments, the present invention is not limited thereto. It will be understood by those skilled in the art that various changes and modifications may be made without departing from the scope of the invention as defined in the following claims.

What is claimed is:

1. An antenna device for generating a reconfigurable high-order mode conical beam, comprising:

a micro-strip radiator having multiple feeding points, wherein one of the feeding points is a fixed feeding point;

a feeding unit for providing two signals having a same amplitude and a preset phase difference, wherein one of the two signals is fed through the fixed feeding point and the other is fed through any one of remaining feeding points; and a mode reconfigurable switching unit, connected to the feeding unit, for performing a switching operation to select any one of the remaining feeding points so that the other signal is feed through the selected feeding point in accordance with mode control data.

2. The antenna device of claim 1, wherein the micro-strip radiator has a single micro-strip circular disk.

3. The antenna device of claim 1, wherein the micro-strip radiator has a micro-strip circular radiator with a circular ring shape.

4. The antenna device of claim 3, wherein the feeding points are positioned at an outer side of the micro-strip circular radiator.

5. The antenna device of claim 1, wherein the micro-strip radiator is formed on a first dielectric substrate whose relative permittivity value is changed depending on a voltage applied thereto.

6. The antenna device of claim 5, wherein the first dielectric substrate is made of a ferro-electric material whose permittivity is changed depending on the applied voltage.

7. The antenna device of claim 1, wherein the feeding unit comprises any one of a T-matching signal distributor, a 90° branch line coupler, and a Wilkinson power distributor.

8. The antenna device of claim 1, wherein the signal fed through the selected feeding point is provided via a transmission line having a length of $\theta a+\theta b$, and the signal provided from the feeding unit to the mode reconfigurable switching unit is provided to the selected feeding point a transmission lines having a length of $\theta a+\theta b$ between each output terminal of the mode reconfigurable switching unit and each of the remaining feeding points.

9. The antenna device of claim 8, wherein the length $\theta b$ is 0° or 180°.

10. The antenna device of claim 9, wherein the signal fed through the fixed feeding point is provided via a transmission line having a length of $\theta a+\theta b$.

11. The antenna device of claim 1, wherein the mode reconfigurable switching unit comprises an SP4T (Single-Pole Four-Throw) switch.

* * * * *